US005999132A

United States Patent [19]

Kitchener et al.

[11] Patent Number: 5,999,132

[45] **Date of Patent: *Dec. 7, 1999**

[54] MULTI-RESONANT ANTENNA

[75] Inventors: Dean Kitchener, Brentwood, United Kingdom; Ronald Harvey Johnston, Calgary, Canada

[73] Assignee: Northern Telecom Limited, Montreal, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,384

[22] Filed: Oct. 1, 1997

[30] Foreign Application Priority Data

| | | | |
|---|---|---|---|
| Oct. 2, 1996 | [GB] | United Kingdom | 9620646 |
| Feb. 28, 1997 | [GB] | United Kingdom | 9704262 |
| Aug. 28, 1997 | [GB] | United Kingdom | 9715835 |

[51] Int. Cl.[6] ..... H01Q 1/24; H01Q 9/28

[52] U.S. Cl. ..... 343/702; 343/795; 343/729; 343/790

[58] Field of Search ..... 343/702, 790, 343/791, 792, 795, 700 MS, 729, 730; H01Q 1/24, 1/38, 1/00, 9/28

[56] References Cited

U.S. PATENT DOCUMENTS

| | | | |
|---|---|---|---|
| 4,509,056 | 4/1985 | Ploussios | 343/791 |
| 4,829,316 | 5/1989 | Nakasa et al. | 343/792 |
| 4,940,989 | 7/1990 | Austin | 343/749 |
| 5,359,340 | 10/1994 | Yokota | 343/895 |
| 5,416,490 | 5/1995 | Popovic | 343/700 MS |
| 5,572,227 | 11/1996 | Pal et al. | 343/895 |
| 5,604,972 | 2/1997 | Mccarrick | 343/895 |

FOREIGN PATENT DOCUMENTS

| | | | |
|---|---|---|---|
| 22843 | 6/1972 | Australia | H01Q 1/36 |
| 0590534 A1 | 4/1994 | European Pat. Off. . | |
| 0650215 A2 | 4/1995 | European Pat. Off. . | |
| 0791977 A2 | 8/1997 | European Pat. Off. . | |
| 3732994 A1 | 4/1989 | Germany . | |
| WO97/12417 | 4/1997 | WIPO . | |

*Primary Examiner*—Hoanganh Le
*Attorney, Agent, or Firm*—Lee, Mann, Smith, McWilliams, Sweeney & Ohlson

[57] ABSTRACT

The present invention relates to antennas and in particular relates to a multi-resonant antenna. The present invention addresses the requirement for dual frequency antennas operable in two distinct frequency bands. In accordance with a first aspect of the invention, there is provided a multi-resonant antenna comprising first and second conductive elements which antenna elements extend relative to a ground plane; wherein the elements of the antenna structure are adapted to couple between themselves to provide a variable phase velocity for surface currents of the radio signals. A method of operation is also disclosed.

23 Claims, 16 Drawing Sheets

MULTI-RESONANT ANTENNA

FIELD OF THE INVENTION

The present invention relates to antennas and in particular relates to a multi-resonant antenna.

BACKGROUND TO THE INVENTION

One type of antenna is the monopole antenna which has a length corresponding to a quarter wavelength of its design frequency. This design is efficient, robust, provides a good bandwidth and, typically, can be a good match to a 50 Ω input impedance. FIG. 1 shows an example of such an antenna. Nevertheless the quarter wavelength monopole is relatively long and is limited to multiple frequency usage at the third and fifth harmonic frequencies. Whilst it may be possible to operate the antenna in two frequency bands associated with different radio systems, where the operating frequency of one band is a harmonic of the other operating frequency band, such an overlap would not be tenable because of the inevitable interference effects. Further, radio frequency spectrum allocation is not, typically, based upon the harmonics of a primary band.

A second type of antenna is the so-called top loaded monopole which is similar in many respects to the first type of antenna as described above but is three dimensional and has a circular planar element attached to the top of the monopole. FIG. 2 shows an example of such an antenna configuration. This design can only operate in a single frequency band, has increased lateral dimensions and does not have a high efficiency—nevertheless, such an antenna has found application in many applications, where a reduction in overall dimensions is preferred.

OBJECT OF THE INVENTION

It is an object of the present invention to provide a multi-resonant antenna that is simple and inexpensive to fabricate.

It is also an object of the present invention to provide a planar multi-resonant antenna.

It is a further object of the present invention to provide a multi-resonant antenna further for use in mobile telephone equipment operable according to multiple operating frequencies.

STATEMENT OF THE INVENTION

In accordance with a first aspect of the invention there is provided a multi-resonant antenna comprising first and second conductive elements which antenna elements extend relative to a ground plane; wherein the elements of the antenna structure are adapted to couple between themselves to provide a variable phase velocity for surface currents of the radio signals.

In accordance with a second aspect of the invention there is provided a multi-resonant antenna comprising first and second coupled lines operable to transmit and receive radio signals, a feed and a ground plane; wherein the feed provides radio signals to the first line, which line extends relative to the ground plane, and; wherein the lines are coupled such that at a first frequency, the phase velocity of the surface currents across the coupled lines are increased and, at a second, higher frequency, the phase velocity of the surface currents across the coupled lines are decreased.

The coupled transmission lines can be coupled at a distal end of the first transmission line (conductive element); said second line can be parallel with said first line. A third coupled line can be present, which third line can be parallel with said first line.

In accordance with a further aspect of the invention there is a provided a multi-resonant antenna comprising first, second and third coupled lines operable to transmit and receive radio signals, a feed and a ground plane; wherein the feed provides radio signals to the first line, which line extends relative to the ground plane, and; wherein the lines are coupled such that at a first frequency, the phase velocity of the surface currents across the coupled lines are increased and, at a second, higher frequency, the phase velocity of the surface currents across the coupled lines are decreased.

A fourth coupled line may be provided, which fourth line can be parallel with said first line. A fifth coupled line may be provided, which fifth line can be parallel with said first line.

In accordance with a further aspect of the invention there is a provided a multi-resonant antenna comprising adjacently placed conductive lines, which lines have a Schiffman phase frequency response whereby, at a high frequency mode of operation, the phase velocity of surface currents is reduced and at a lower frequency mode of operation, the phase velocity of surface currents is increased.

In accordance with another aspect of the invention there is provided method of operating a multi-resonant antenna, said multi-resonant antenna comprising first and second coupled lines operable to transmit radio signals, a feed and a ground plane, wherein the first line extends relative to the ground plane;

wherein, in a transmit mode, the method comprises the steps of providing radio signals, via the feed, to the first line, wherein the lines are coupled such that at a first frequency, the phase velocity of the surface currents across the coupled lines are increased and, at a second, higher frequency, the phase velocity of the surface currents across the coupled lines are decreased; whereby the lines resonate and the signals are transmitted via the lines.

In accordance with a still further aspect of the invention there is provided a method of operating a multi-resonant antenna, said multi-resonant antenna comprising first and second coupled lines operable to receive radio signals, a feed and a ground plane, wherein the first line extends relative to the ground plane;

wherein, in a receive mode, the method comprises the steps of receiving radio signals, via the coupled lines such that at a first frequency, the phase velocity of the surface currents across the coupled lines are increased and, at a second, higher frequency, the phase velocity of the surface currents across the coupled lines are decreased; whereby the lines resonate and the coupled radio signals are output via the feed.

BRIEF DESCRIPTION OF THE DRAWINGS

In order that the present invention can be more fully understood and to show how the same may be carried into effect, reference shall now be made, by way of example only, to the Figures as shown in the accompanying drawing sheets wherein.

DETAILED DESCRIPTION OF THE PREFERRED EMBODIMENTS

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific.

Figure 1:
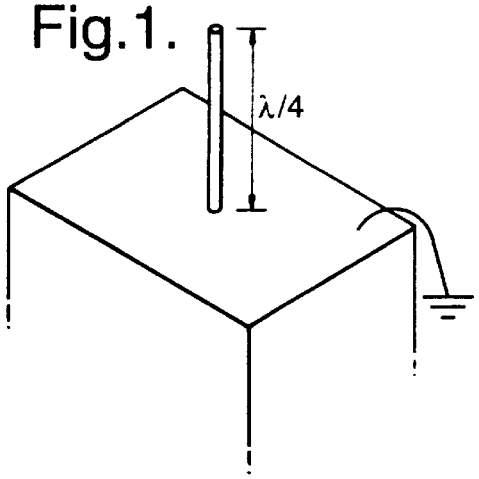
FIG. 1 shows a monopole antenna.
Figure 2:
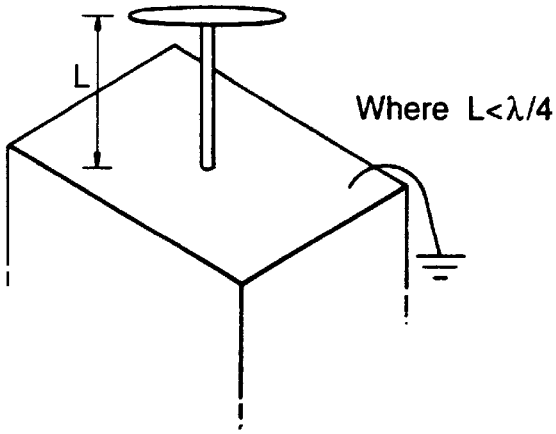
FIG. 2 shows a top-loaded monopole antenna.
Figure 3:
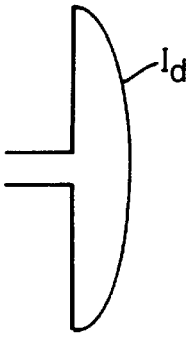
FIG. 3 depicts a half-wavelength dipole equivalent of a quarter wavelength monopole.
Figure 4:
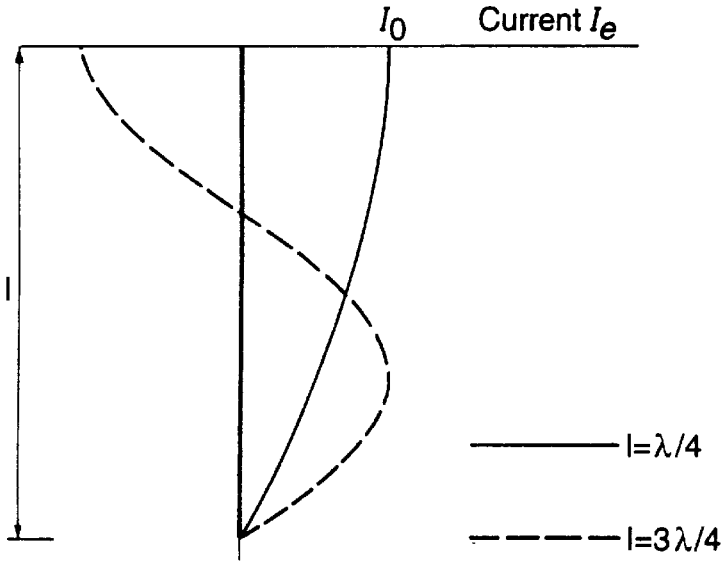
FIG. 4 shows the current distribution along a monopole for lengths of a quarter-wavelength and three-quarters-wavelength.

Widespread use has been made of the quarter wavelength monopole antenna, which will radiate with respect to a ground plane. In the case of mobile communications handset antennas, the ground plane is provided by the casing associated with the handset electronics enclosure. For analysis purposes, the quarter wavelength monopole, such as is depicted in FIG. 1 may be viewed as possessing a quarter wavelength image and it forms the half wavelength equivalent, as shown in FIG. 3. FIG. 4 shows the resulting current distribution pattern along the length of a linear monopole antenna, for several wavelengths corresponding to $\lambda/4$ and $3\lambda/4$, where $\lambda$ is the free space wavelength.

Figure 5:
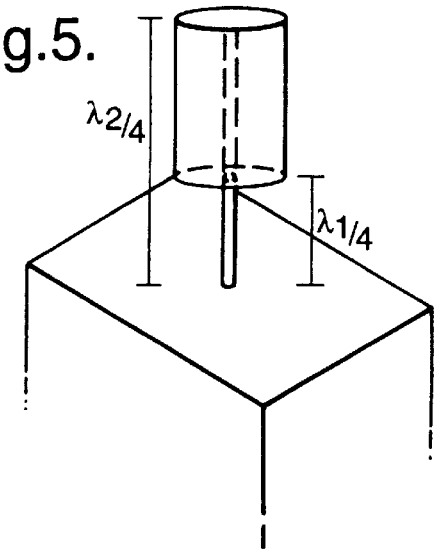
FIG. 5 shows a three dimensional dual resonant monopole.
Figure 6:
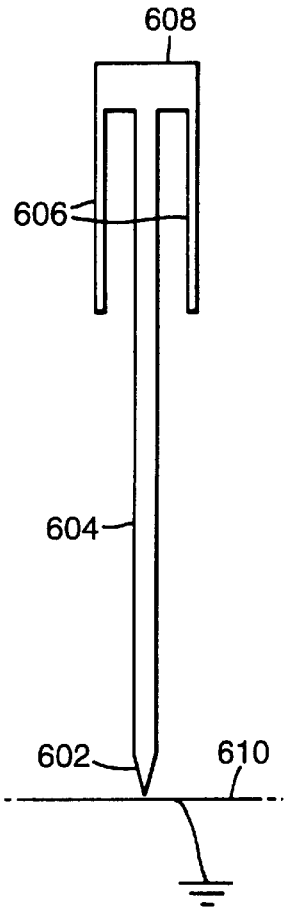
FIG. 6 shows a first embodiment of the invention.

FIG. 5 shows an example of a dual resonant antenna. The antenna has a top loaded cap which is folded down around and circumferentially spaced from a central conductor and is of reduced lateral dimension relative to the top loaded monopole. The top loading cap provides a current blocking effect at the higher frequency band. In the high frequency band, the upper coaxial structure stops current flow on the central conductor and the non-coaxial part of the antenna acts as a quarter wavelength monopole at a higher frequency thereby allowing dual band operation at frequency $F_1(\lambda_1/4)$ and frequency $F_2$ $(\lambda_2/4)$ This type of antenna is a three dimensional structure having equal X and Y co-ordinate dimensions, which may limit the applicability of this type of antenna. The first embodiment is a two dimensional equivalent of this three dimensional antenna, which is shown in FIG. 6. The printed antenna comprises a feed part 602 from which a first elongate printed member 604 extends. Second and third elongate members 606 extend parallel on either side of the first member, these second and third members being fed by a member 608 perpendicularly attached to a distal end of the first member. The feed part 602 lies adjacent a ground plane 610 associated with, for example a handset enclosure, and would be connected to a radio frequency transceiver.

Figure 7:
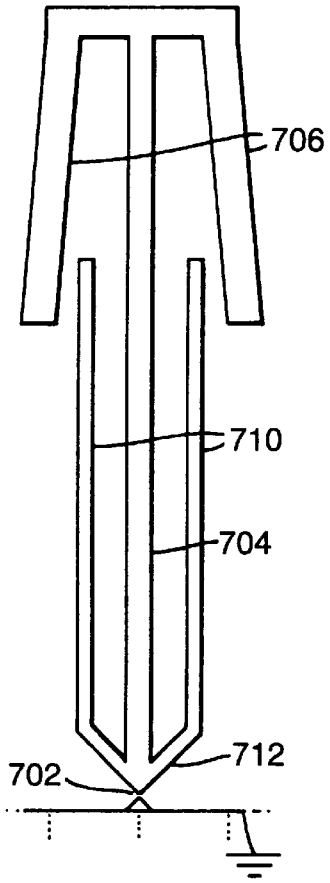
FIG. 7 shows a second embodiment of the invention.
Figure 9:
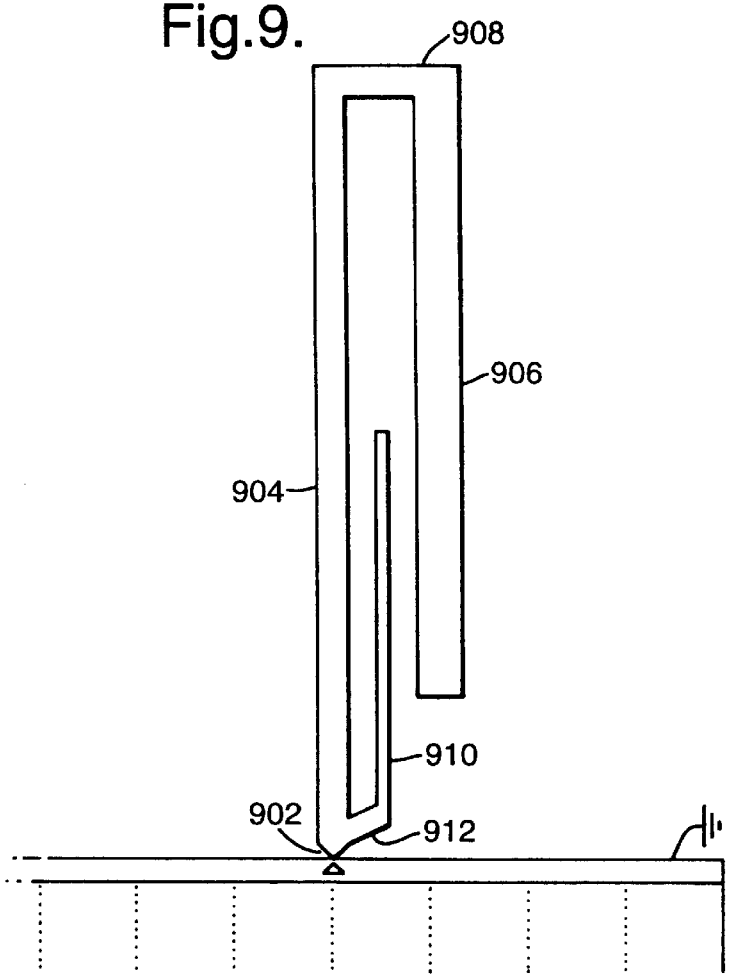
FIG. 9 shows a fourth embodiment of the invention.
Figure 8:
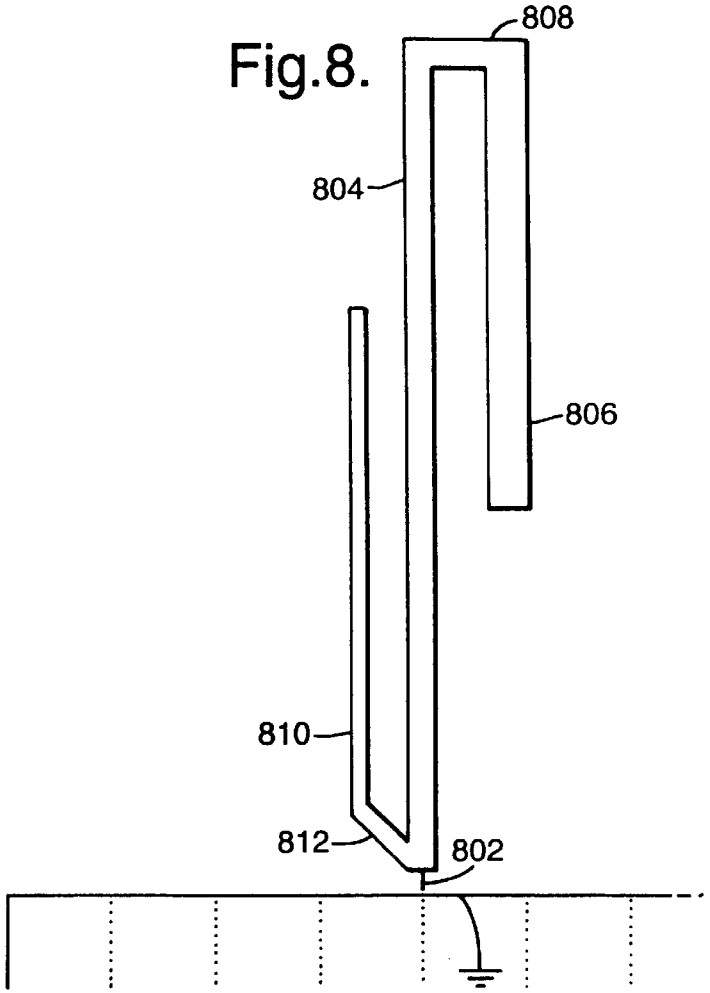
FIG. 8 shows a third embodiment of the invention.
Figure 12:
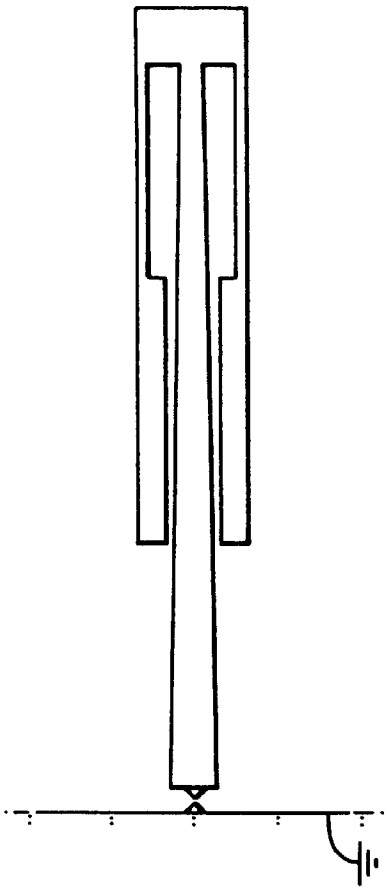
FIGS. 11 & 12 show various embodiments of the invention.
Figure 11:
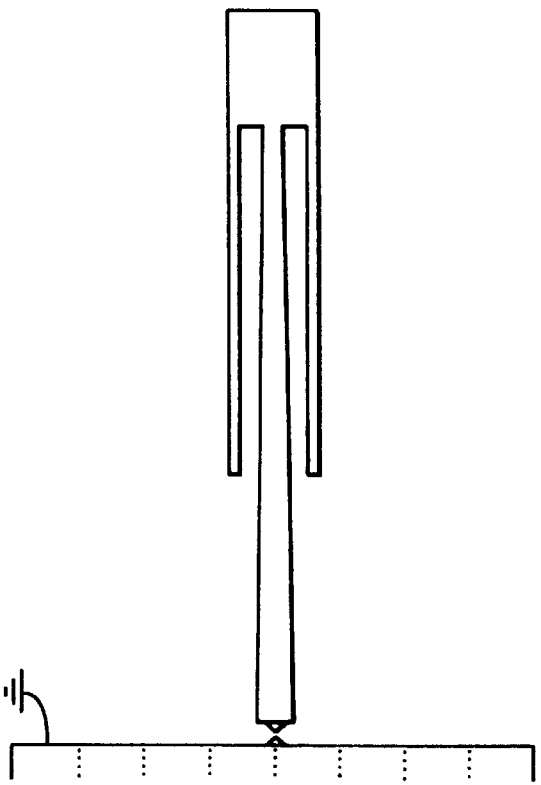
Figure 10:
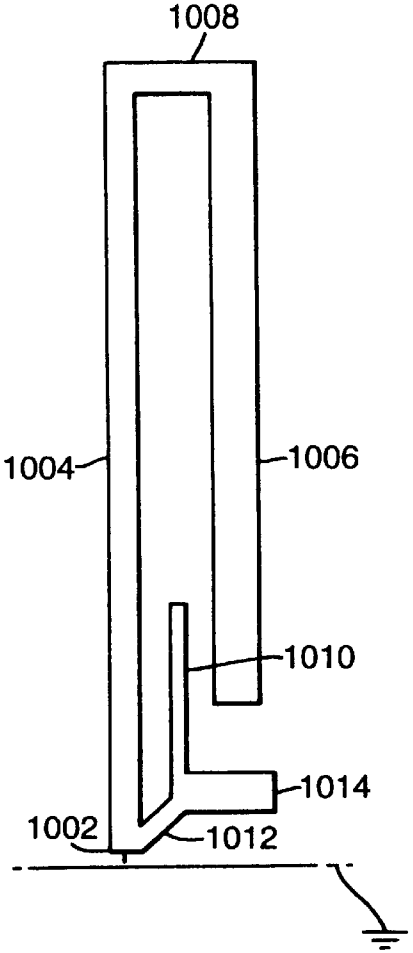
FIG. 10 shows a fifth embodiment of the invention.

FIG. 7 is a second embodiment of the invention and differs from the first embodiment in that two second and third arms 706 are not parallel but diverge from the distal end, and in that fourth and fifth arms 710 lie parallel with the first member 704, said fourth and fifth arms being attached to the first member by connecting members 712. Such divergence of the arms 706 from the distal end reduces coupling between the second and third arms and the fourth and fifth arms and was found to improve the impedance of the structure at higher frequencies. FIG. 8 is an alternative to this design in that there are no third and fifth arms and that the second arm 806 is parallel with the first member 804. The fourth embodiment, as shown in FIG. 9, is a still further variant of the design of FIG. 7; second 906 and third 910 arms lie on the same side of the first element 904 whereby lateral dimensions are reduced. FIG. 10 shows an antenna similar to the fourth embodiment (FIG. 8) but has a stub element 1014 which was found to improve matching. FIGS. 11–12 show two other suitable configurations of antenna which can perform in a multi-resonant fashion which further variants can have triangular elements. Whilst being compact in the longitudinal dimensions of the first element from the feed point, the lateral dimensions are increased—which of course may be acceptable depending upon the overall design requirements of the dual band installation.

Examples can be conveniently manufactured employing printed copper tracks on a dielectric substrate such as FR4. Flexible dielectric substrates can be employed which, in the case of a mobile communications handset, would enable the antenna to be flexible, which in turn could be more appealing to the end user. In order to reduce the antenna length (analogous to the height of the antenna when used as a handset antenna) it is possible to curve the structure but this increases the lateral dimensions with consequential changes being necessary for manufacturing requirements.

Figure 13:
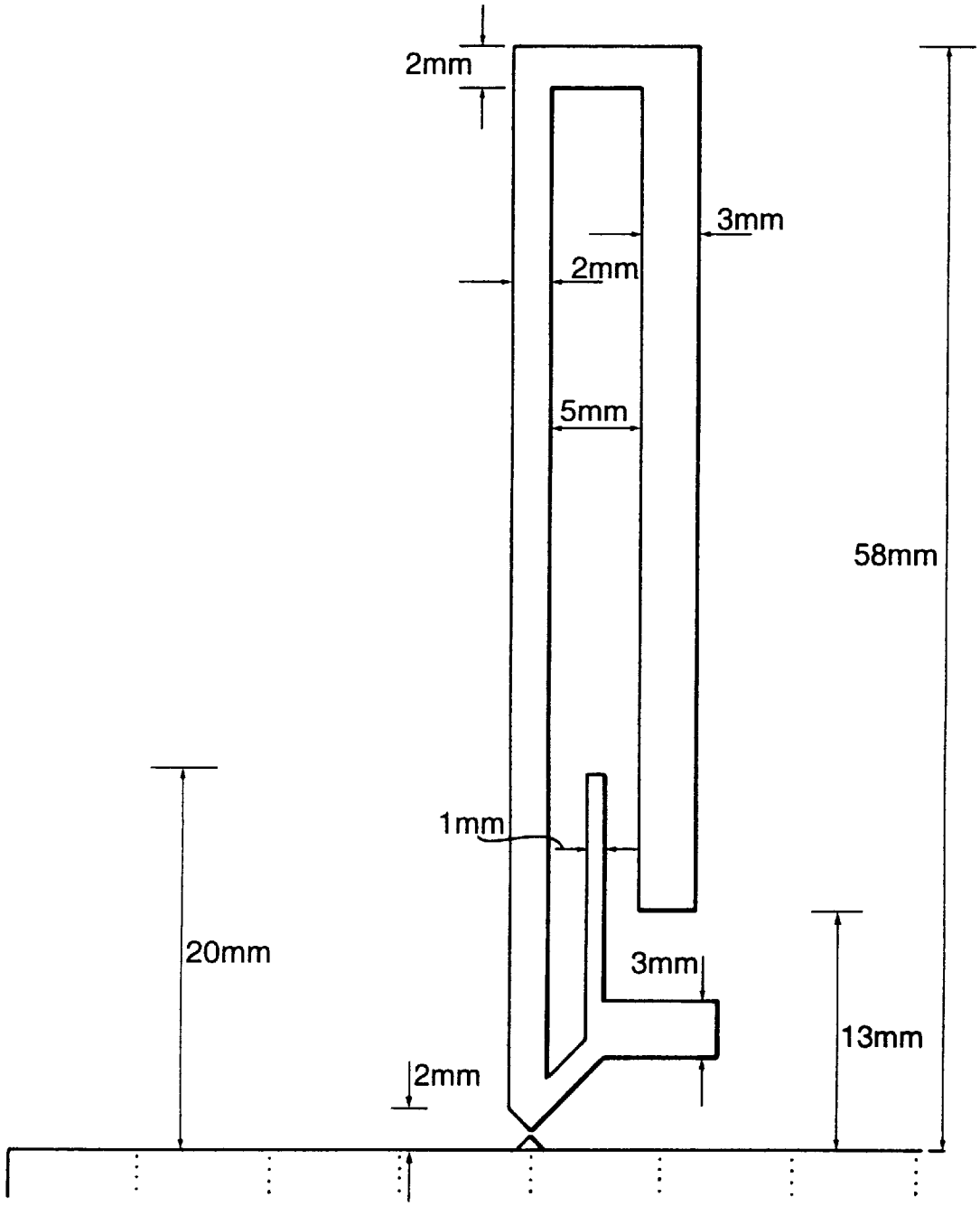
FIG. 13 shows approximate dimensions for the lengths of the antenna elements of the fifth embodiment.
Figure 14A:
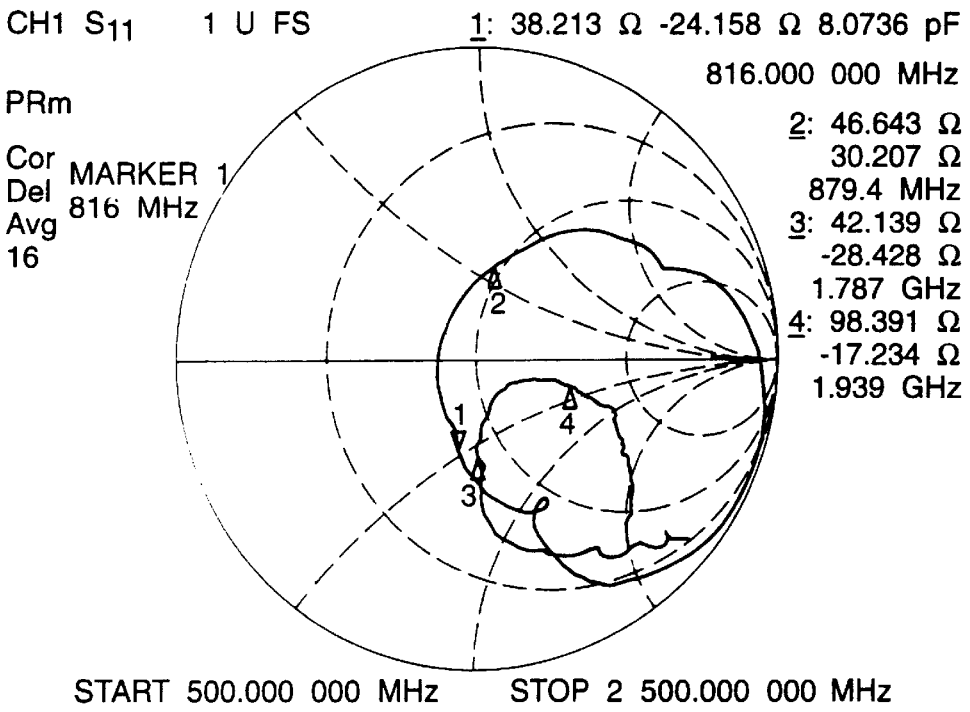
FIGS. 14*a–j* show graphical performance data.
Figure 14B:
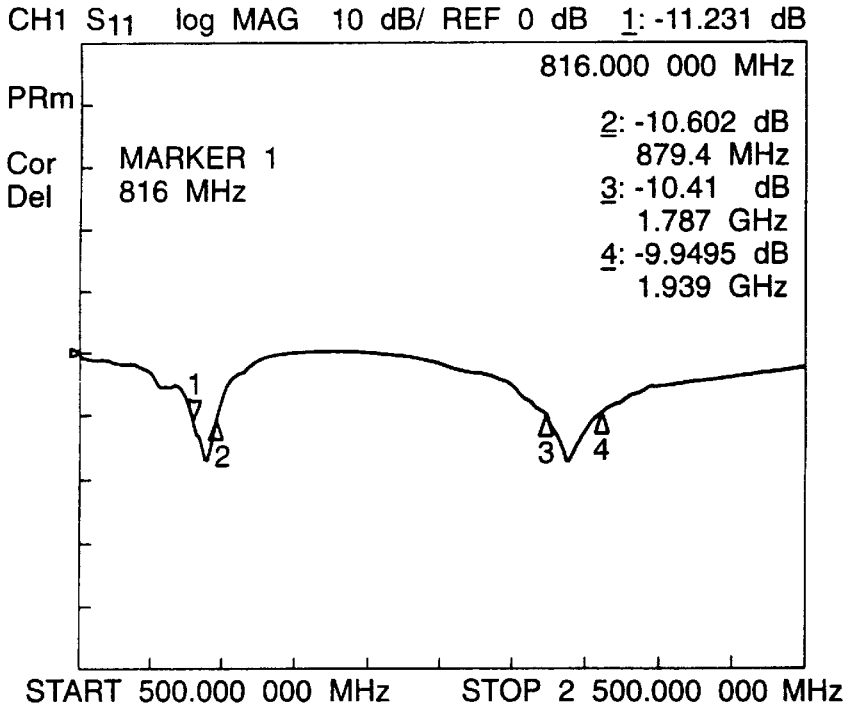
Figure 14C:
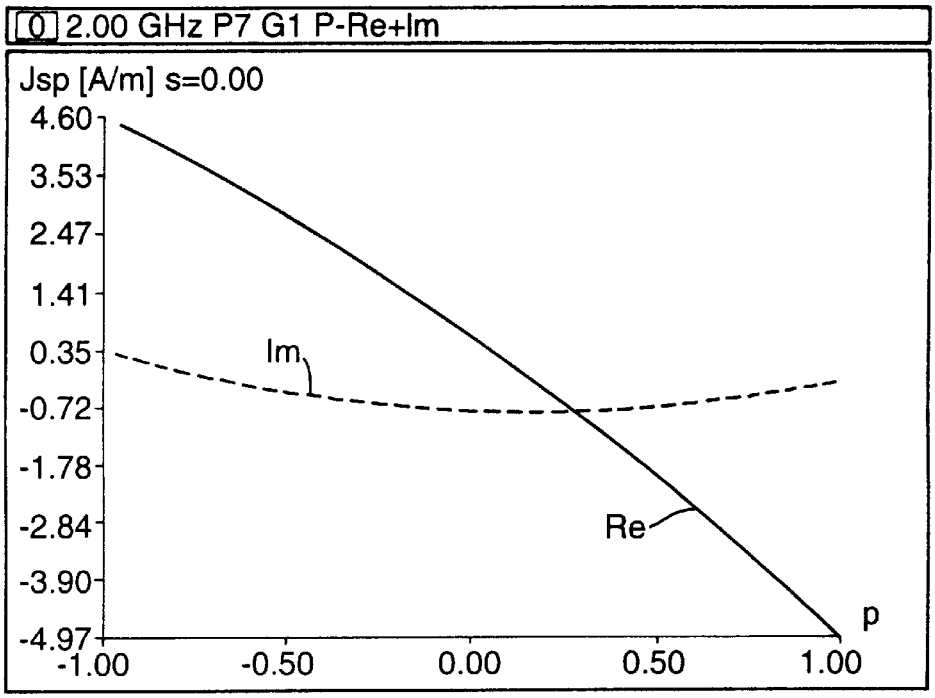
Figure 14D:
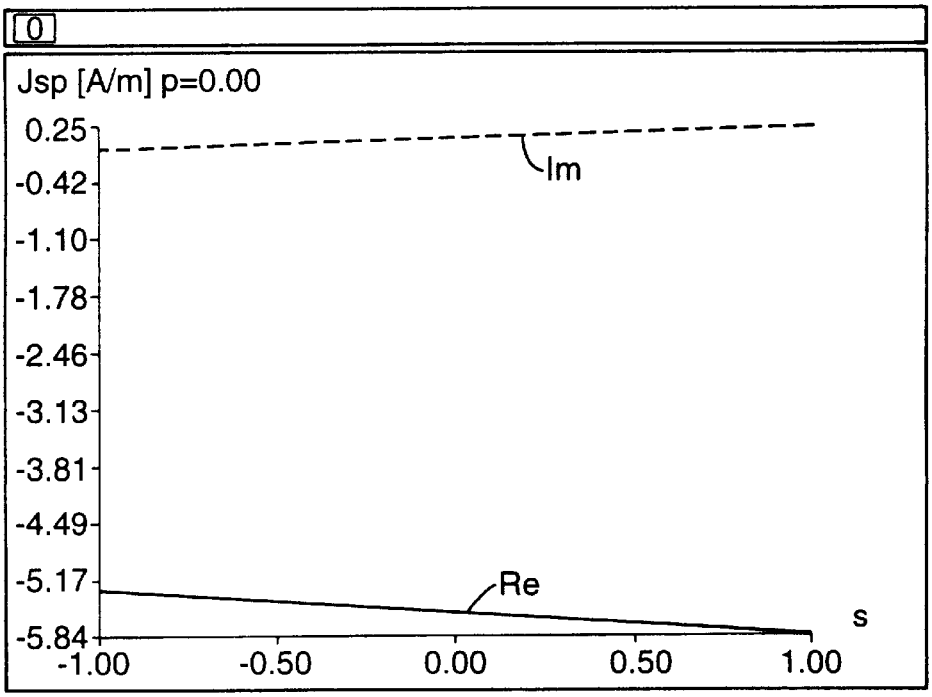
Figure 14E:
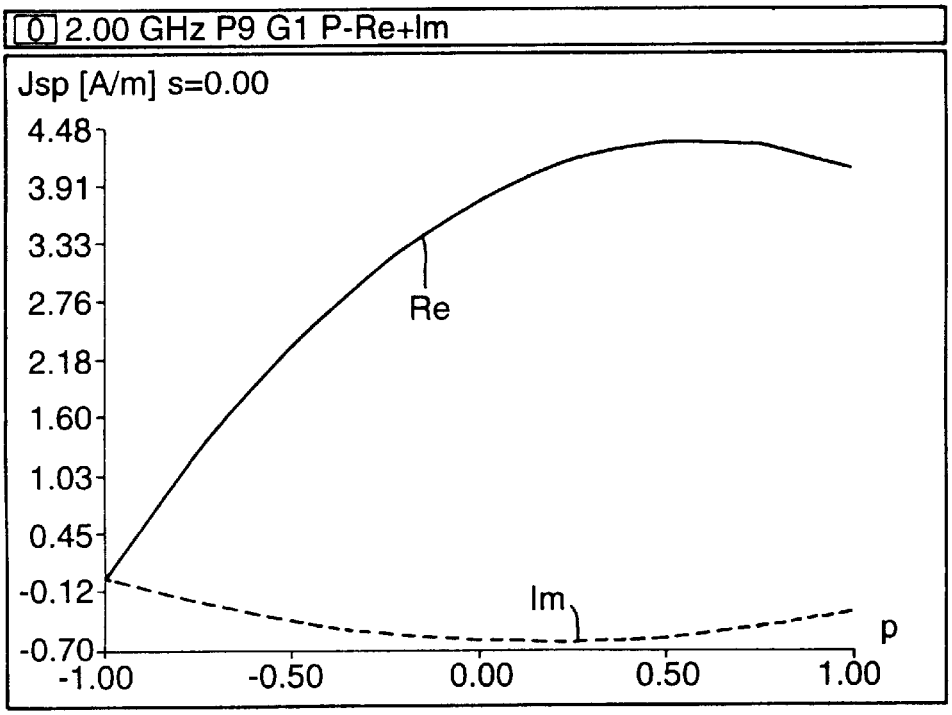
Figure 14F:
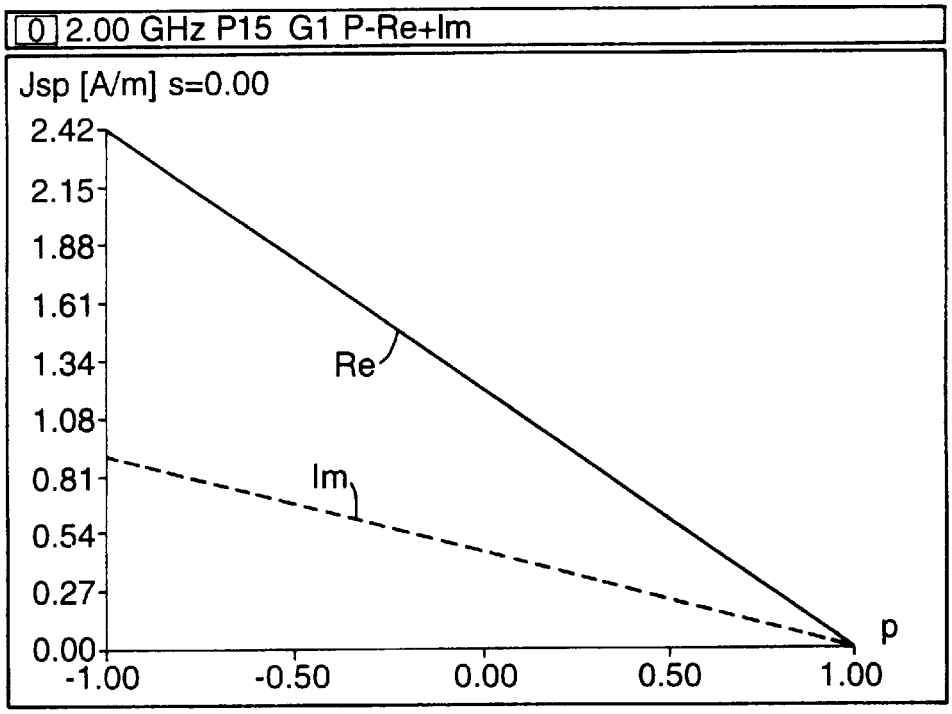
Figure 14G:
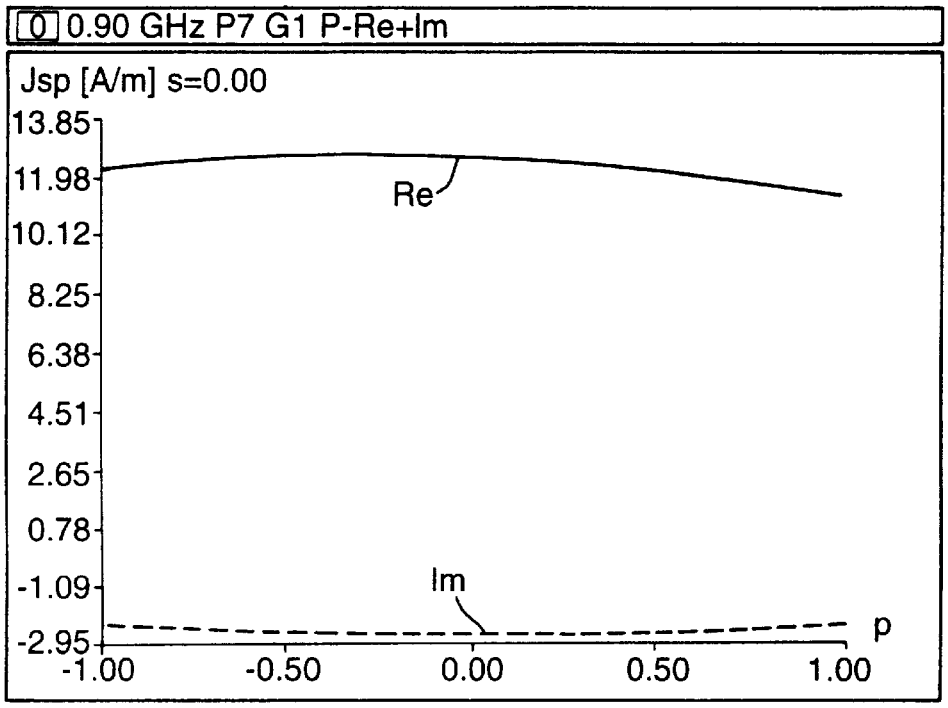
Figure 14H:
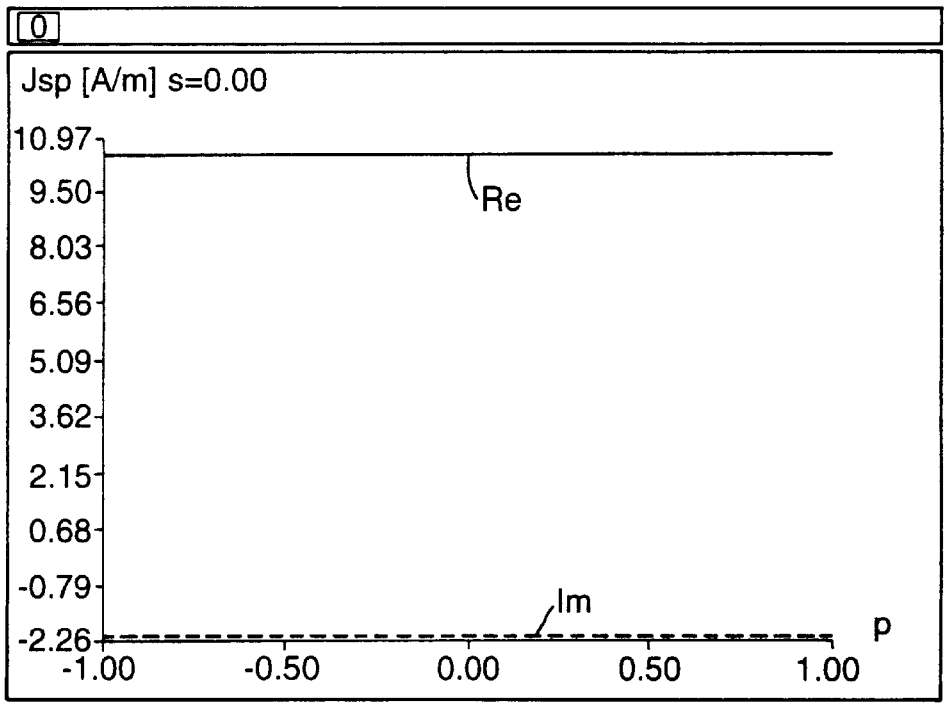
Figure 14I:
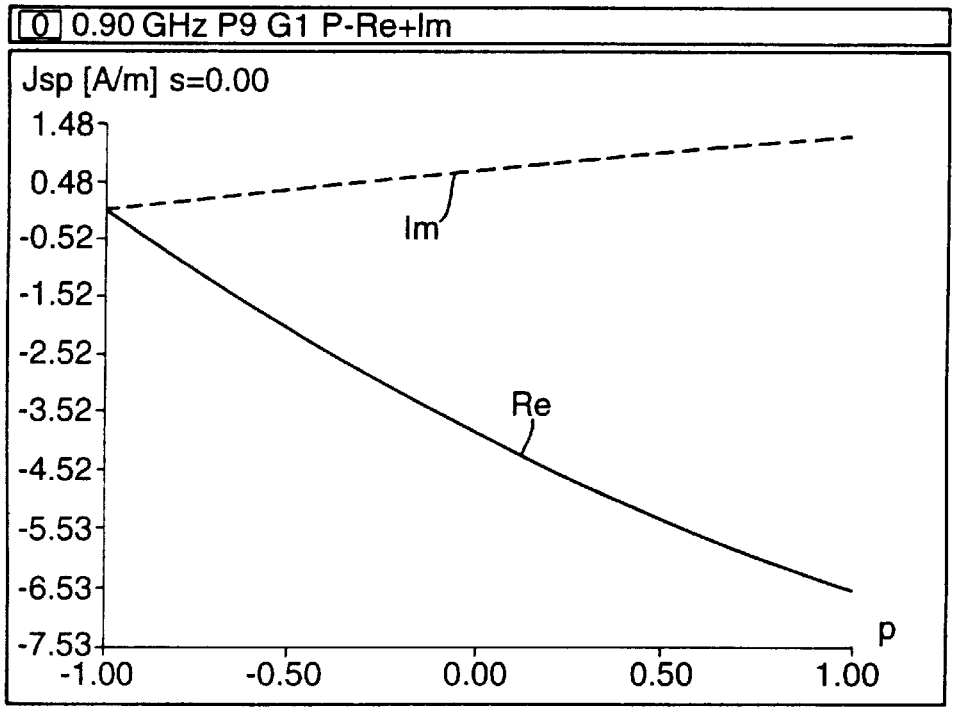
Figure 14J:
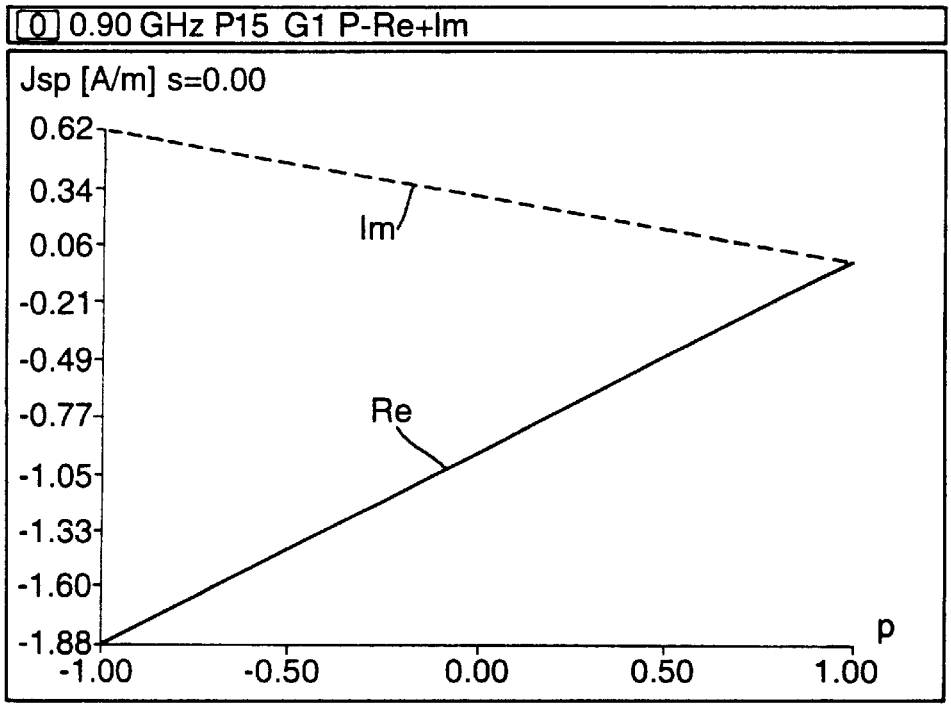

Referring now to FIGS. 13 onwards, the operation of an antenna made in accordance with the invention will now be discussed. FIG. 13 shows approximate dimensions for the lengths of the antenna elements of the fifth embodiment for operation at 824–894 MHz and 1.850–1.99 GHz frequency band of operation. This embodiment was tested within an anechoic chamber and was subject to numerical electromagnetic code moment method computer simulation using computer test and analysis programs known under the WIPL brand. FIG. 14 *a* shows a Smith chart and FIG. 14 *b* shows an S11 plot for this antenna in the frequency range 0.5–2.5 GHz. The performance in FIGS. 14 *c–f* show the real and imaginary current distributions, which have the form of the third harmonic, at 2.0 GHz for the antenna elements 1004, 1008, 1006 and 1010 respectively. When scaled relative to the actual lengths of the antenna it can be seen that the antenna structure provides a decreased phase velocity relative to free space. This lowers the resonance from that expected with respect to the structure shown in FIG. 5. In contrast, and with reference to FIGS. 14 *g–j,* the real and imaginary current distributions at 0.9 GHz are shown. These have the form of the first harmonic or fundamental. When scaled relative to the actual lengths of the antenna, it can be seen that the antenna structure provides an increased phase velocity relative to free space.

At two particular frequencies, 900 MHz and 1.85 GHz, it was calculated that the antenna structure had an apparent length of 0.33 λ and 0.678 λ, respectively. Typically these should be 0.25 λ and 0.75 λ for a straight monopole. This result can be explained with reference to a Schiffman phase frequency response. The Schiffman effect is observed in a coupled transmission line structure having two of its ends connected together, the input impedance $Z_{in}$ of which being determined by the equation: $Z_{in}=(Z_{0e}\cdot Z_{0o})^{1/2}$, where $Z_{0e}$ and $Z_{0o}$ are the even and odd-mode characteristic impedances, respectively of the coupled section. Antennas made in accordance with the invention have non-uniform characteristic impedances along the coupled transmission lines formed between the first and second antenna members which are parallel or divergingly spaced apart from a coupled point (such as the distal end of the first antenna member). Since the antennas made in accordance with the invention extend perpendicularly from a ground plane: this means that the characteristic impedance of the antenna elements varies as the structure projects outwardly and thus can affect the coupling between the two transmission lines.

Figure 15A:
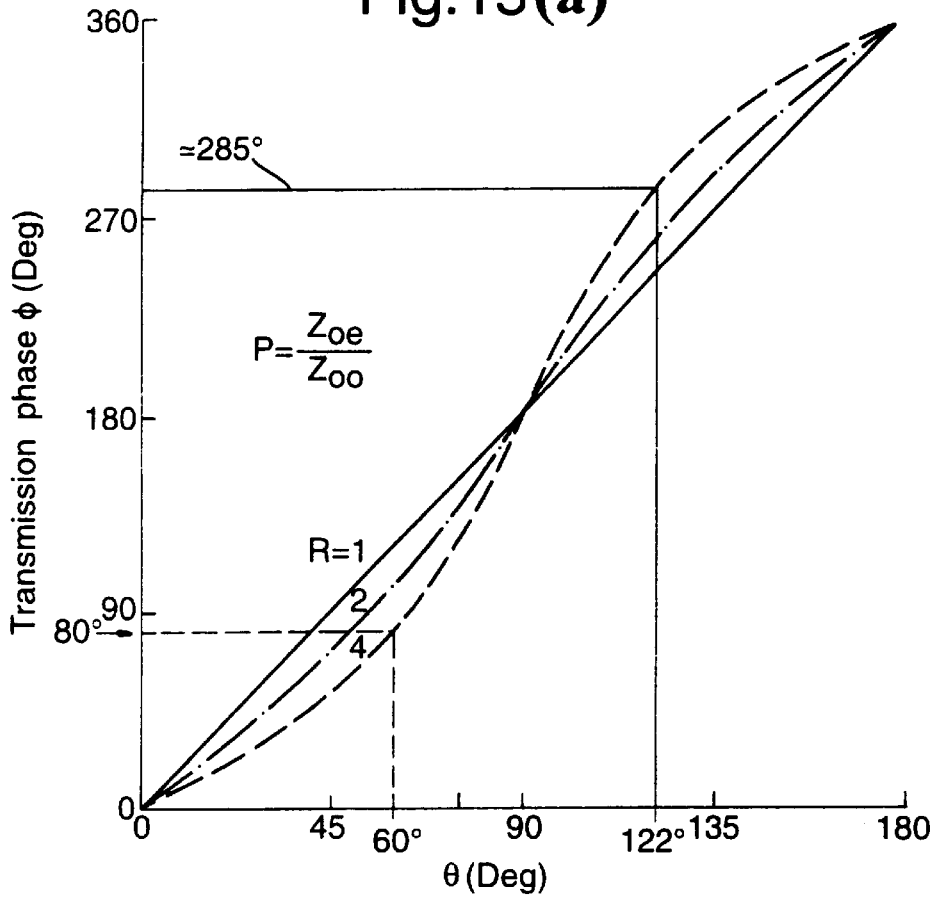
FIG. 15(*a*) shows an exemplary Schiffman phase shifter phase response as a function of frequency for a conductive C-section, 15(*b*)
Figure 15B:
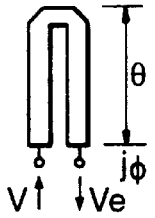
Figure 16A:
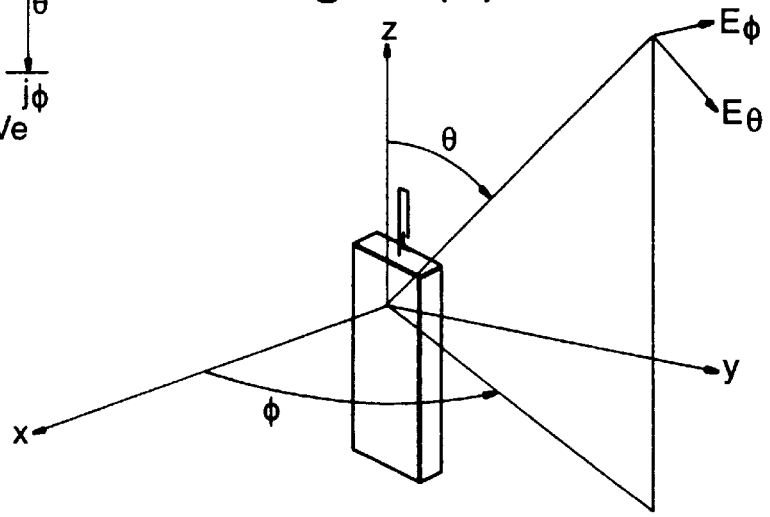
FIGS. 16 *a–e* show a co-ordinate system and gain and cross-polarization levels relating to the fifth embodiment at two frequencies.
Figure 16B:
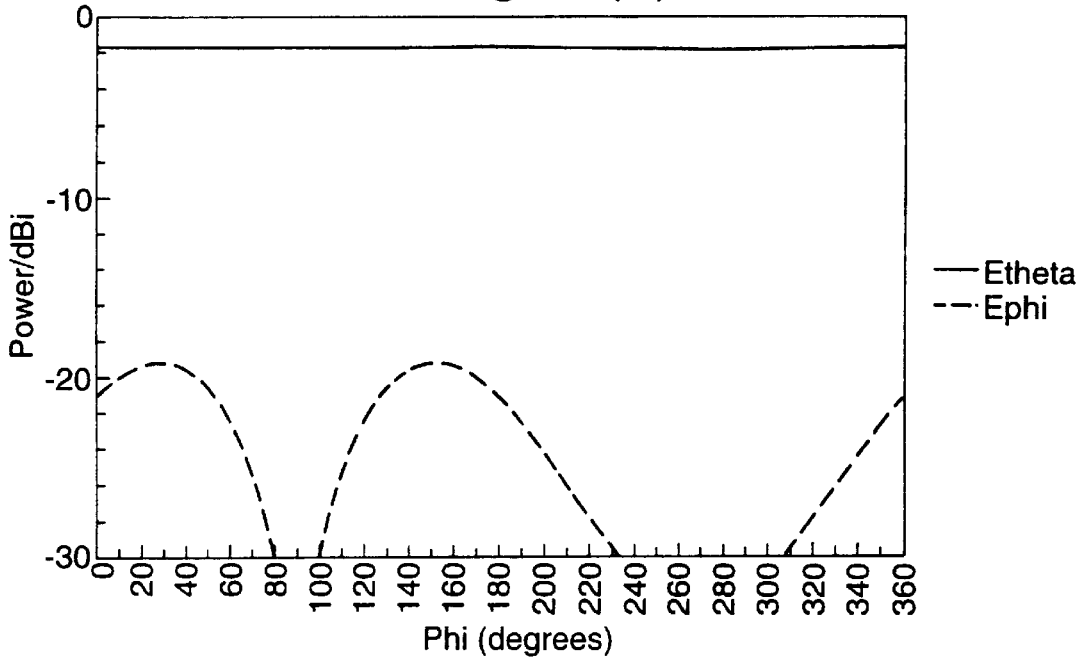
Figure 16C:
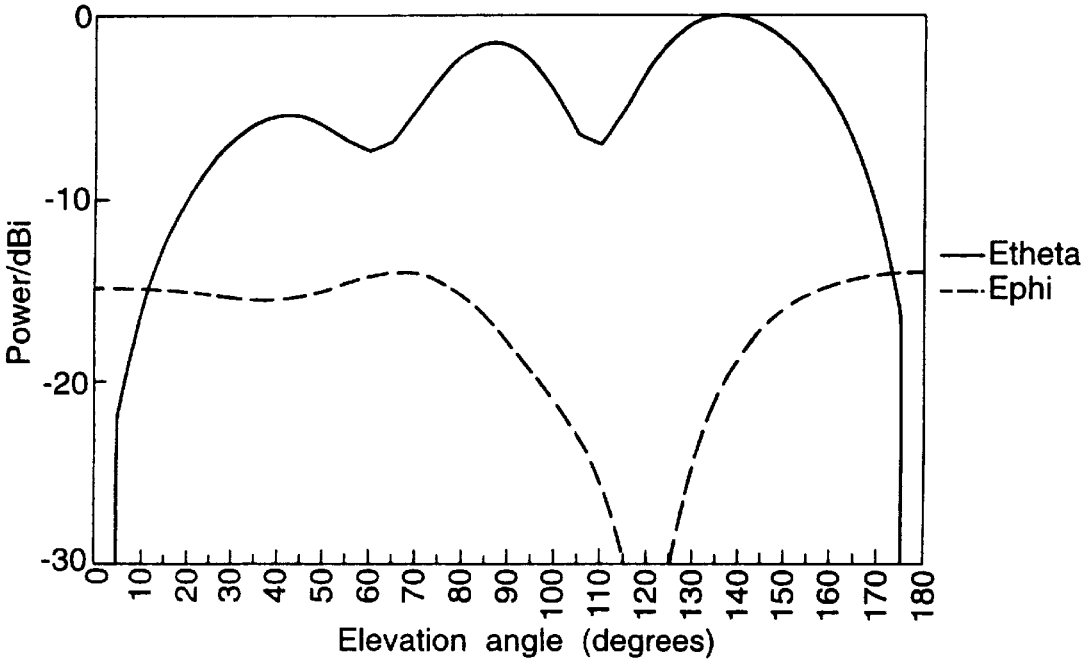
Figure 16D:
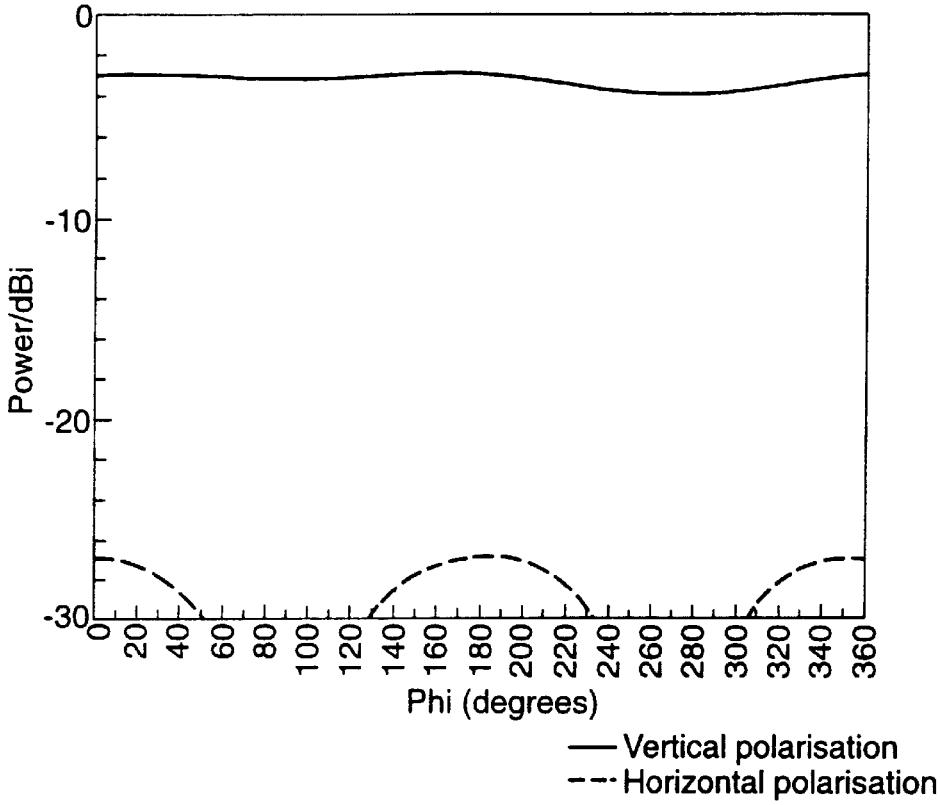
Figure 16E:
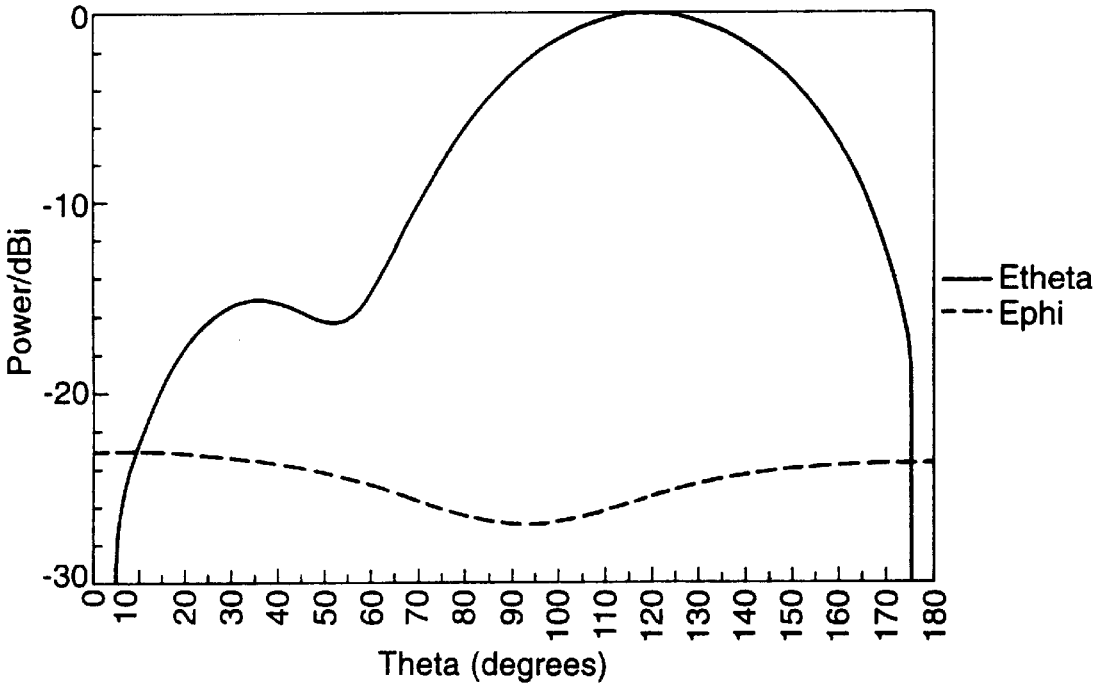

Referring now to FIG. 15(*a*), there is shown a Schiffman graph (transmission phase-frequency response plot) for a homogeneous section shown in FIG. 15(*b*): at 860 MHz, I=120°, i.e. υ on the graph is 60° and, assuming a typical ratio of $Z_{0e}/Z_{0o}=4$, we obtain a transmission phase change of 80°; a phase delay of 86° would be sufficient to allow the monopole to resonate. The structure provides increased phase velocity relative to free space. At 1.85 GHz, I=244°, υ on the graph is 122° and a transmission phase delay of approximately 285° is obtained, although a figure closer to 259° would be preferred. The structure provides a reduced phase velocity relative to free space at this frequency. The Schiffman effect can enable a variation of operable frequency bands for an antenna provided there is adequate matching. Thus the $Z_{0e}/Z_{0o}$ value is controllable by varying the spacing between the coupled transmission lines. The antennas that have been made have proved to be somewhat shorter than pure theory would suggest.

Turning now to FIGS. 16, there are shown selected radiation patterns relating to the fifth embodiment at 2.0 GHz and 900 MHz. For reference purposes, FIG. 16*a* explains the spherical co-ordinate system employed. Note that the scale on the graphs for the circular co-ordinates refer to υ=180° for the vertically downward direction and υ=0° for the vertically upward direction. The gain and cross-polarization levels are shown in FIGS. 16*b* and 16*c* for the azimuth pattern and the elevation pattern at 2.0 GHz, respectively. The gain is omni-directional ±10%, (±1 dB); the cross-polarization levels are low, being of the order of 20 dB lower than the co-polar levels. FIGS. 16*d* and 16*e* show the gain and cross-polarization levels for the azimuth pattern and the elevation pattern at 900 MHz, with the gain again being omni-directional ±10%, (±1 dB); and the cross-polarization levels being low.

Figure 17:
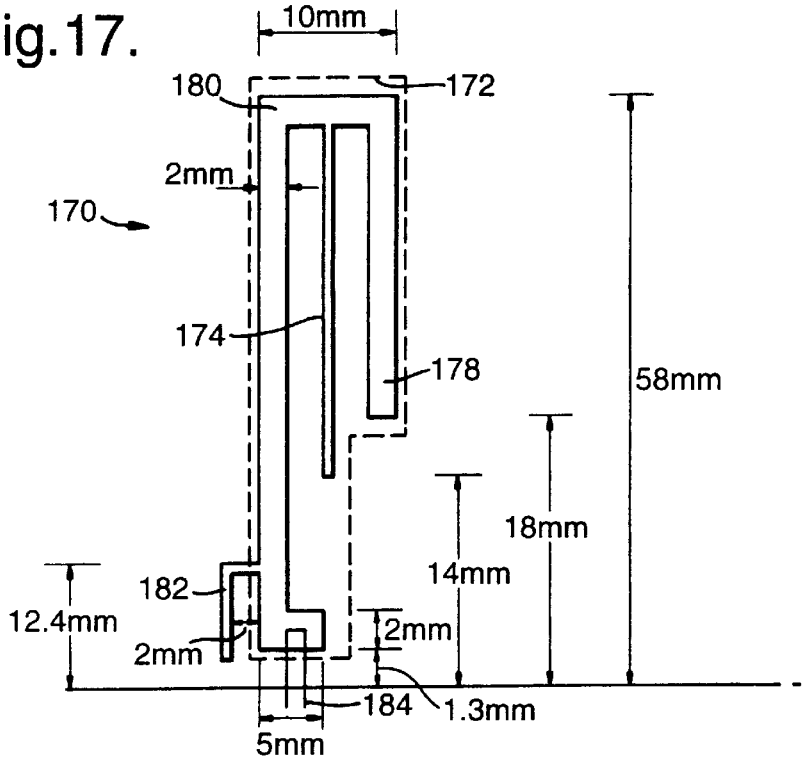
FIG. 17 shows a further embodiment.
Figure 18:
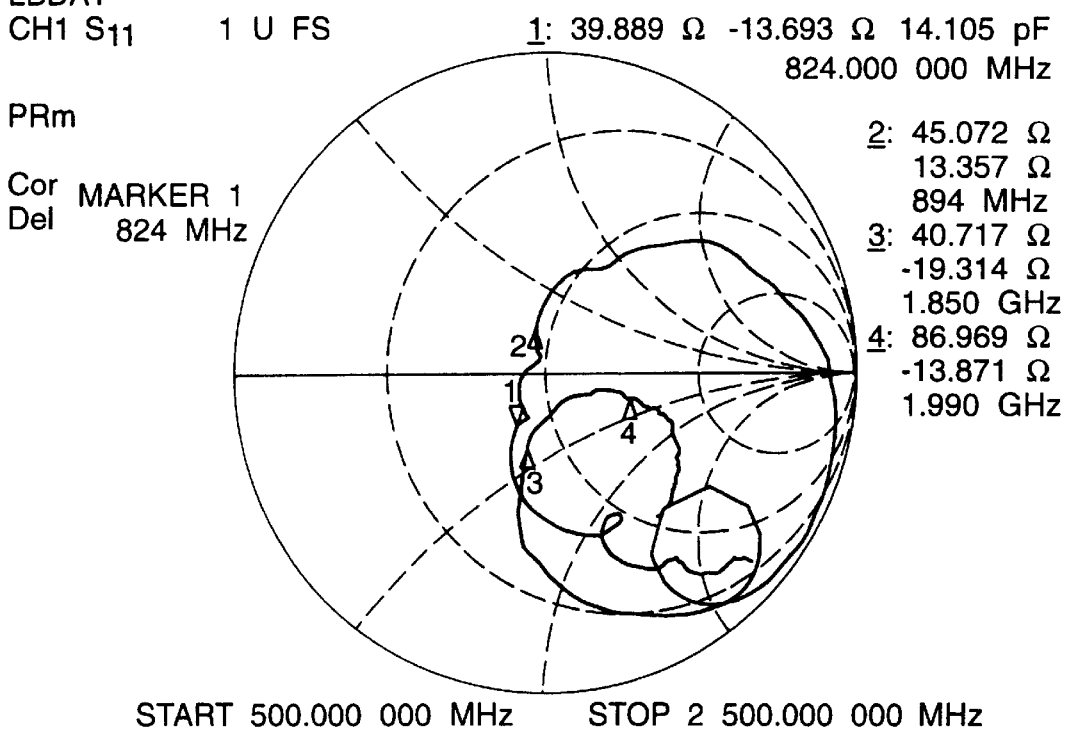
FIG. 18 shows a Smith chart for the embodiment of FIG. 17.
Figure 19:
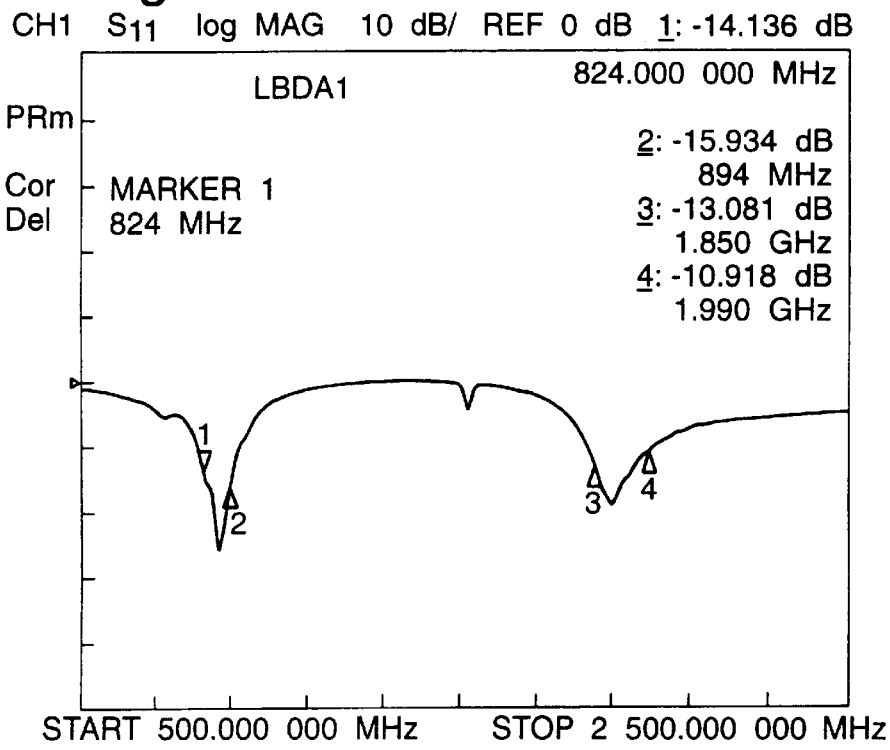
FIG. 19 shows the S11 plot of the embodiment of FIG. 17.

Referring now to FIG. 17, there is shown a further embodiment of the invention which was fabricated on a 2.5 mm thick FR4 dielectric substrate 172 and has dimensions as detailed. The antenna 170 comprises a general unequal U-shape copper track, with a copper wire 174 of 0.84 mm diameter lying parallel to the arms 176, 178 of the U and spaced therebetween, being connected to the connecting section 180 of copper track between the arms. A matching element 182 comprising a small length copper wire is positioned proximate the feed point 184. The antenna was mounted on a 150×55×20 mm box (not shown) to simulate the ground characteristics of a radio telecommunications handset, the copper tracks being fed via an sma connector (not shown) coupled to a microwave test generator. Further tuning of the antenna is possible for the design shown, as is within the scope of a skilled person, whereby the output of the antenna can be tailored to a particular requirement. A Smith chart is shown in FIG. 18 and an S11 plot is shown in FIG. 19.

Figure 20:
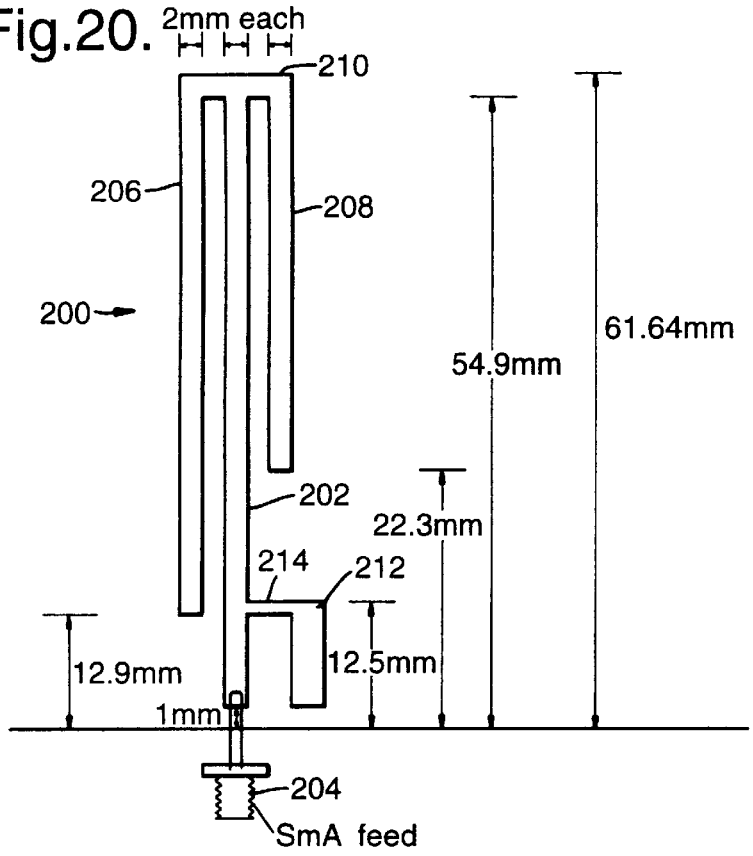
FIG. 20 shows a still further embodiment.
Figure 21:
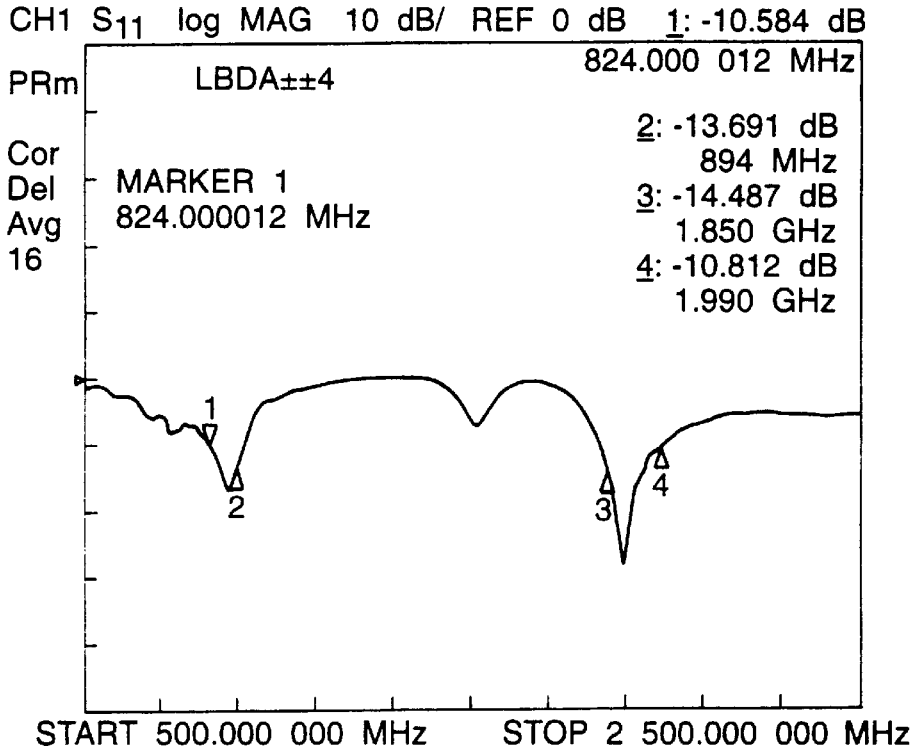
FIG. 21 shows the S11 plot of the embodiment of FIG. 20.
Figure 22:
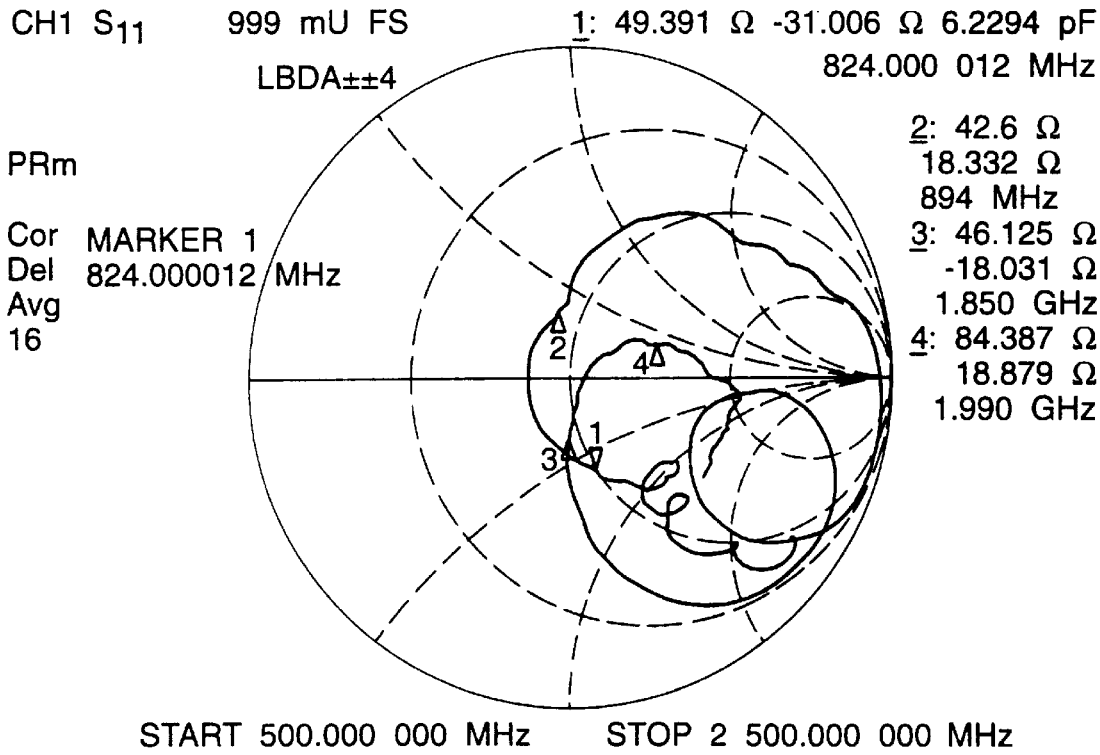
FIG. 22 shows a Smith chart for the embodiment of FIG. 20.

FIG. 20 shows a still further embodiment with dimensions as detailed, the antenna 200 comprising a general W-shape, with the central arm 202 being the longest and being connected to an sma connector feed 204 and the outside arms 206, 208 being of different length, being connected at 210 to the central conductor. As is the case with the antenna described above, a matching element 212 is positioned proximate the feed point, with a copper wire of 0.93 mm diameter connecting the matching element to the central conductor, the antenna being mounted on a box as above. An S11 plot is shown in FIG. 21: four modes of resonance are apparent, at the following frequencies: 720 MHz, 870 MHz, 1520 MHz and 1890 MHz. At the lower frequency, mode of operation, the wavelength is longer than that of the higher frequency signals and there is a greater phase velocity. Accordingly, the resonances are closer together. Conversely, at the higher frequency mode of operation, the wavelength is shorter and the phase velocity is reduced relative to the lower frequency and two higher frequency resonances are further apart in terms of frequency spacing. A corresponding Smith chart is shown in FIG. 22.

Although the transmission lines of the embodiments have been made from plated dielectric substrates, the transmission line structures could comprise other types of conductive materials, such as metallic wires. An advantage, if the antenna is fitted to a mobile communications handset is that if the antenna is broken, then it is more likely to be easily and cheaply replaced. If made on a flexible dielectric support structure, then it would be less liable to fracture when carried. Alternatively, the dielectric supporting the antenna could be slideable relative to a handset casing.

We claim:

1. A multi-resonant planar antenna comprising first and second conductive elements disposed in a plane that are connected to a single RF feed adjacent a ground plane; the elements of the antenna are of a length and spacing relative to each other such that electromagnetic radio signals carried thereby can couple between themselves to provide a variable phase velocity for surface currents of the radio signals.

2. A multi-resonant planar antenna comprising first and second coupled lines disposed in a plane and operable to transmit and receive radio signals, a single RF feed and a ground plane, the coupled lines are connected via a physical electrical conductor to the feed and the feed exchanges radio signals with the first line, which line extends from the ground plane, and; the lines are coupled such that at a first frequency, the phase velocity of the surface currents across the coupled lines are increased and, at a second, higher frequency, the phase velocity of the surface currents across the coupled lines are decreased.

3. A multi-resonant antenna according to claim 2 wherein the coupled lines are transmission lines and are coupled at a distal end of the physical electrical conductor.

4. A multi-resonant antenna according to claim 2, wherein said second line is parallel with said first line.

5. A multi-resonant antenna according to claim 2, further comprising a third coupled line.

6. A multi-resonant antenna according to claim 2, further comprising a third coupled line, which third line is parallel with said first line.

7. A multi-resonant antenna comprising first, second and third coupled lines operable to transmit and receive radio signals, a single RF feed and a ground plane wherein the coupled lines are connected via a physical electrical conductor to the feed; wherein the feed exchanges radio signals with the first line, which line extends outwards from the ground plane, and; wherein the lines are coupled such that at a first frequency, the phase velocity of the surface currents across the coupled lines are increased and, at a second, higher frequency, the phase velocity of the surface currents across the coupled lines are decreased.

8. A multi-resonant antenna according to claim 7, further comprising a fourth coupled line, which fourth line is parallel with said first line.

9. A multi-resonant antenna according to claim 7, further comprising a fourth coupled line, which fourth line is connected to the first line proximate to the feed.

10. A multi-resonant antenna according to claim 7, further comprising a fifth coupled line, which fifth coupled line is connected via a physical electrical conductor connected to the feed.

11. A multi-resonant antenna according to claim 7, further comprising a fifth coupled line, which fifth line is parallel with said first line and is connected via a physical electrical conductor connected to the feed.

12. A multi-resonant antenna according to claim 7, further comprising a fifth coupled line, which fifth line is connected to the first line proximal the feed.

13. A multi-resonant planar antenna comprising adjacently placed conductive lines disposed in a plane, the lines being connected via a physical electrical conductor to a single RF feed, which lines have a frequency response such that, at a high frequency mode of operation, the phase velocity of surface currents is reduced and at a lower frequency mode of operation, the phase velocity of surface currents is increased.

14. A method of operating a multi-resonant antenna, said multi-resonant antenna comprising first and second coupled lines disposed in a plane and operable to transmit radio signals, a single RF feed and a ground plane, the first line extends from the ground plane and the coupled lines are connected via a physical electrical conductor to the single RF feed;

wherein, in a transmit mode, the method comprises the steps of providing radio signals, via the feed, to the first line, wherein the lines are coupled such that at a first frequency, the phase velocity of the surface currents across the coupled lines are increased and, at a second, higher frequency, the phase velocity of the surface currents across the coupled lines are decreased; whereby the lines resonate and the signals are transmitted via the lines.

15. A multi-resonant antenna according to claim 14 wherein the coupled lines are transmission lines and are connected at a distal end of the physical electrical conductor.

16. A multi-resonant antenna according to claim 14, wherein said second line is parallel with said first line.

17. A multi-resonant antenna according to claim 14, further comprising a third coupled line.

18. A multi-resonant antenna according to claim 14, further comprising a third coupled line which third coupled line is connected via a physical electrical conductor connected to the feed line, which third coupled line is parallel with said first coupled line.

19. A method of operating a multi-resonant planar antenna, said multi-resonant planar antenna comprising first and second coupled lines disposed in a plane and operable to receive radio signals, a single RF feed and a ground plane, the first line extends from the ground plane, and the coupled lines are connected via a physical electrical conductor to the single RF feed;

wherein, in a receive mode, the method comprises the steps of receiving radio signals, via the coupled lines such that at a first frequency, the phase velocity of the surface currents across the coupled lines are increased and, at a second, higher frequency, the phase velocity of the surface currents across the coupled lines are decreased; whereby the lines resonate and the coupled radio signals are output via the feed.

20. A multi-resonant antenna according to claim 19 wherein the coupled lines are transmission lines and are connected at a distal end of the physical electrical conductor.

21. A multi-resonant antenna according to claim 19, wherein said second line is parallel with said first line.

22. A multi-resonant antenna according to claim 19, further comprising a third connected line.

23. A multi-resonant antenna according to claim 19, further comprising a third coupled line which third line is connected via a physical electrical conductor connected to the feed, which third line is parallel with said first line.

* * * * *